United States Patent [19]

Tai

[11] 4,374,747

[45] Feb. 22, 1983

[54] BLEACH PRODUCTS

[75] Inventor: Ho T. Tai, Santes, France

[73] Assignee: Lever Brothers Company, New York, N.Y.

[21] Appl. No.: 136,136

[22] Filed: Mar. 31, 1980

[30] Foreign Application Priority Data

Apr. 20, 1979 [FR] France ..... 79 10064

[51] Int. Cl.[3] ..... C11D 3/395; C11D 7/54; C11D 17/00

[52] U.S. Cl. ..... 252/186.26; 252/90; 252/95; 252/97; 252/99; 252/186.25; 252/186.27; 252/186.31; 252/186.32

[58] Field of Search ..... 252/186, 90, 174.13, 252/95, 99, 186.25, 186.26, 186.31; 8/111

[56] References Cited

U.S. PATENT DOCUMENTS

| | | | |
|---|---|---|---|
| 3,637,339 | 1/1972 | Gray | 252/174.13 |
| 3,945,936 | 3/1976 | Lucas et al. | 252/186 |
| 3,989,638 | 11/1976 | Bradley et al. | 252/90 |
| 3,992,317 | 11/1976 | Brichard et al. | 252/186 |
| 4,009,113 | 2/1977 | Green et al. | 252/186 |
| 4,118,304 | 2/1980 | Clarke et al. | 252/90 |

*Primary Examiner*—Herbert B. Guynn
*Attorney, Agent, or Firm*—James J. Farrell

[57] ABSTRACT

A bleach product comprising a percompound contained within a closed water-insoluble but water-permeable bag of fibrous material, provided with a protective water-impermeable coating which is removable in water at a temperature of 30°-75° C., preferably 35°-65° C. The bleach product can be used in fabric washing machines for bleaching fabrics with or without a detergent product.

12 Claims, No Drawings

BLEACH PRODUCTS

This invention relates to bleach products which are suitable for bleaching fabrics and which contain a bleaching powder comprising a percompound.

The bleach products of the invention can be used in fabric washing machines for bleaching fabrics with or without a detergent product.

Inorganic percompounds, such as sodium perborate and sodium percarbonate, are widely used in detergent compositions to give them bleaching properties. These percompounds provide a satisfactory bleach when the detergent composition is used at the boil, but at lower temperatures their action is rather slow to substantially nil. This is a considerable disadvantage in view of the wide use of washing machines operating at temperatures up to 60° C. As a matter of fact, about ⅔ of all washings at the present time are carried out at temperatures below 60° C., partly because of the recent move of fabric material to synthetics and partly because coloured fabrics have become more popular. Hence only about ⅓ of all washings is carried out at high temperatures.

However, a major part of commercial detergent compositions is designed for washing at higher temperatures. If such detergent compositions are used for washing at lower temperatures, the inorganic percompound present therein, usually at a level of approximately 20–30% by weight, is more or less wasted.

Furthermore, laboratory investigations have shown that, for washing at lower temperatures, less builder, e.g. sodium triphosphate, and less foam-depressor, e.g. soap, than the amounts present in high temperature wash-formulations are needed.

All this excess of active ingredients in detergent powder compositions intended for the high temperature wash is therefore ineffectively used when the compositions are used for washing at temperatures lower than 60° C.

A further disadvantage is that, when using washing machines which have a rotating drum in which the fabrics are placed, there can be substantial losses of the bleaching powder as a result of its accumulation in the dead spaces beneath the drum, i.e. so-called mechanical/sedimentation losses.

Another form of loss is the uncontrolled decomposition of the bleaching agent, which can take place already at lower temperatures due to the action of certain oxydo-reducto enzymes present in the soiled wash load.

It has been proposed previously to present inorganic percompound bleaches packed in closed water-soluble or water-dispersible sachets, but such products have not met with much commercial success as yet. The main reason for this is the difficulty of finding a material that is suitable for making the sachets so that the contents of the sachets are only released at the correct temperature and yet the product is adequately protected from inside and outside influences during handling, storage and transport.

It is an object of the present invention to achieve a more economic use of percompound bleaches.

It is another object of the invention to optimise washing in general and the performance of percompound bleaches. These and other objects, which will be apparent hereinafter, can be achieved if the percompound bleach is contained within a closed water-insoluble but water-permeable bag of fibrous material provided with a protective water-impermeable coating, which is removable in water at a temperature of 30°–75° C. The term "percompound" is used here to indicate both inorganic and organic percompounds, and as such will include e.g. the alkali-metal perborates, percarbonates, persilicates, perpyrophosphates, urea peroxide, as well as potassium monopersulphate and the various organic peracids.

The present invention therefore provides an improved bleach product which comprises a percompound, contained within a closed water-insoluble but water-permeable bag of fibrous material provided with a protective water-impermeable coating which is removable in water at a temperature of 30°–75° C.

Bags formed in this way have a great resistance to both mechanical action and to chemical attack by the bleaching composition contained therein, and yet can be made, if desired, with cheap cellulosic fibres. In addition, the protective coating prevents dusting out of the powdered alkaline bleach composition through the pores of the bag during manual handling, prevents the access of atmospheric moisture to the bleach powder, and provides a means for controlling the bleach to be dispersed or dissolved out of the bag at the desired moment.

The bags used to form the products of the invention are of the type which remains closed during the washing and/or bleaching process. They are formed from water-insoluble fibrous sheet material which can be in the form of paper or of woven, knitted or non-woven fabric, which should have a high wet-strength so as not to disintegrate during the washing and/or bleaching process under higher temperature conditions. The sheet material used should have a pore size such that, before applying the protective coating, there is no appreciable leaking of the bleach composition through the material of the bags in the dry state, but yet that, after removal of the protective coating, water can pass readily through the material forming the bags to disperse and dissolve the contents when the product is used.

A suitable sheet material for forming the bags can be for example water-permeable paper or non-woven fabric of high wet strength, weighing about to 5 to 100, preferably 10–80 g/m$^2$, especially about 40–75 g/m$^2$. Suitable sheet materials of this type are commercially available and have pore sizes of about 20–1000 microns. The fibres preferably used for the sheet materials may be of natural or synthetic origin and may be used alone or in admixture, for example polyamide, polyester, polyacrylic, cellulose acetate, polythene, PVC, polypropylene or cellulosic fibres. If natural fibres are used, it may be desirable to include a proportion of long fibres, such as Manilla hemp, in order to improve the strength of the sheet material, and polymeric treatment, e.g. coating, may also be necessary for increasing the wet strength. It is preferred to include at least a proportion of thermoplastic fibres, for example polypropylene fibres, for increasing resistance to chemical attack by the bleaching agent, and also for facilitating heat sealing of the bags.

Preferred sheet materials are polyester and polypropylene.

The removable protective coating material used for covering the bag is an organic material which is solid at room temperature but which will disperse or dissolve in the wash liquor at a temperature of 30°–75° C., preferably from 35°–65° C. It can be applied to the sheet material before or after forming the bags, to give the desired protective effect. It can also be applied by dipping the bag—after it has been filled with the bleach composition and sealed—in a bath comprising the molten protective agent, or by using a brush.

Specific protecting coating materials which may be mentioned are waxes, fatty acids, algic acids, ethoxylated or non-ethoxylated fatty alcohols, and polyvinyl alcohols, which are solid at room temperature and which can be applied to the sheet material to form a protective coating. Such materials are dispersible or soluble in the wash liquor at the above elevated temperatures where, apart from releasing the bleaching composition to the wash liquor, they can exert a beneficial lather controlling effect. The waxes can be of natural or synthetic origin and optionally halogenated to improve chemical stability. The fatty acids can be a mixture of long chain fatty acids having a chain length of about 14 to 22 carbon atoms and having a melting point above 30° C. Preferred fatty acids are $C_{16}$–$C_{18}$ fatty acids, such as stearic acid. Algic acids are material of probably formula $(C_6H_8O_6)_n$, which are generally derived from seaweed.

The fatty alcohols can be a mixture of long chain fatty alcohols having a chain length of about 12 to 22 carbon atoms. The polyvinyl alcohol used should be of the so-called "hot" or "warm" water-soluble type. The method of varying the solubility temperature of polyvinyl alcohol is well known in the art, e.g. by varying the polymerisation degree and the degree of hydrolysis.

The protective agent may include a plasticiser to improve its elasticity which avoids cracking and breakage of the layer during storage, transport and handling and also during use in the water in the washing machine under agitating conditions before the desired temperature level. Suitable plasticisers are for example polyethylene-acrylic acid copolymers. For good results the protective coating is generally applied to an extent of 100–300 g/m$^2$ of sheet material, preferably from 150–250 g/m$^2$.

Bags can be formed from a single folded sheet formed into a tubular section or from two sheets of the material bonded together at the edges. For example, the bags can be of sachets formed from single folded sheets and sealed on three sides or from two sheets sealed on four sides for the preferred rectangular shape. Alternatively, the sheets can be folded with envelopes with overlapping flaps to be sealed. Other bag shapes or constructions, for example circular cushion-shaped sachets or of tetrahydron form may be used if desired. The size of the bags is generally relatively small, so that the bleach products of the invention are convenient for use. Products can be made which contain from 0.4 gram to 4 grams, preferably 1–3 grams, of percompound per kg of washload. They can be presented either as small sachets for each kilogram of washload or as larger sachets for multikilo washes. Products for domestic use will generally comprise not more than 20 grams of percompound, preferably between 1–15 grams.

The bleach products in one embodiment of the invention contain an inorganic percompound.

Examples of inorganic percompounds which can be used, are the alkalimetal perborates, persilicates, percarbonates and perphosphates. They can be used as a single compound or as mixtures thereof.

Preferably an alkaline material is included to provide an initial pH in solution of about 10–12, preferably from 10.5–11.5. Suitable alkaline materials which can be used in the bleach products of the invention are for example sodium or potassium silicates, sodium or potassium hydroxides and mixtures thereof.

Products of this embodiment show excellent bleaching performance at higher temperatures and, when used for washing fabrics together with a non-bleaching detergent composition in a washing machine under high temperature conditions, they show a much better bleaching performance as compared with conventional bleach detergent compositions. Consequently with these bleach products of the invention a much better cleaning and bleaching action can be achieved at a lower dosage of percompound bleach per wash.

In another embodiment of the invention the bleach products of the invention comprise an inorganic percompound and an activator for said percompound, which activator will react with the percompound in the wash solution to form organic peracids as the bleaching species. Alternatively organic peracids as such can be used instead of their precursors. This embodiment has the additional advantage that the bleach products can also be used for bleaching at lower temperatures, e.g. 40°–60° C., as well as at higher temperatures, e.g. in the boil wash.

Any activator which is capable of activating the percompound in the presence of water, so that more effective bleaches are obtained at lower temperatures, can be used in the present invention.

Many of such activators are known in the art and have been extensively described in the literature. They are generally compounds which contain N-acyl or O-acyl residues in the molecule and which are believed to exert their activating action on the percompound by forming organic peracids.

A representative but by no means comprehensive list of activators which can be used in the present invention is given below:

(1) Acyl organoamides of the formula $RCONR_1R_2$, where RCO is a carboxylic acyl radical, $R_1$ is an acyl radical and $R_2$ is H or an organic radical, as disclosed in U.S. Pat. No. 3,117,148. Examples of compounds falling under this group are:

(a) N,N-diacetylaniline and N-acetylphthalimide.

(b) N-acylhydantoins, such as N,N'-diacetyl-5,5-dimethylhydantoin.

(c) Polyacylated alkylene diamines, such as N,N,N',N'-tetraacetylmethylene diamine and N,N,N',N'-tetraacetyl-ethylene-diamine, as disclosed in British patent specification No. 907,356.

(d) Acylated glycolurils, such as tetraacetyl glycoluril, as disclosed in British patent specification No. 1,246,338.

(e) α-Acyloxy-(N,N')polyacyl malonamides, such as α-acetoxy-(N,N')-diacetyl malonamide.

(2) Acylated sulphonamides, such as N-methyl-N-bezoyl-menthane sulphonamide and N-phenyl-N-acetyl methane sulphonamide, as disclosed in British patent specification No. 3,183,266.

(3) Carboxylic esters of the type as disclosed in British patent specification No. 836,988. Examples of activators of this type include phenyl acetate, sodium acetoxy benzene sulphonate, trichloroethylacetate, sorbitol hexaacetate, fructose-pentaacetate, p-nitrobenzaldehyde diacetate, isopropenyl acetate, acetyl aceto hydroxamic acid, and acetyl salicylic acid. Other examples are esters of a phenol or substituted phenol with an alpha-chlorinated lower aliphatic carboxylic acid, such as chloroacetylphenol and chloroacetylsalicylic acid, as disclosed in U.S. patent specification No. 3,130,165.

(4) Acyl-cyanurates, such as triacetyl- or tribenzoyl-cyanurates, as disclosed in U.S. Pat. No. 3,332,882.

(5) Carbonic acid or pyrocarbonic acid esters of the formula $R_1OCOOR_2$ or $R_3OCO\text{-}OCO\text{-}OR_2$, as disclosed in British patent specification No. 970,950, for example p-carboxy-phenylethyl-carbonic acid ester, p-carboxyphenyl-ethyl pyrocarbonic acid ester, and sodium sulpho phenylethyl carbonic acid ester.

(6) Optionally substituted anhydrides of benzoic or phthalic acid, for example benzoic anhydride, m-chlorobenzoic anhydride and phthalic anhydride.

Preferred activators are the polyacylated alkylene diamines of group (1) (c) above, particularly N,N,N',N'-tetraacetyl ethylene diamine.

These activators may be used in a weight ratio of from about 1:1 to about 1:35 to the percompound.

For bleach products comprising a peracid or an inorganic percompound in conjunction with an activator, the protective coating should preferably be removable at the lower end of the temperature range, e.g. 30°–50° C., whereas for bleach products comprising an inorganic percompound without an activator said protective coating should preferably be removable at the upper end of the temperature range, e.g. 50°–75° C., more particularly at a temperature of 50°–65° C.

The bleach products of the invention may further comprise sodium triphosphate as an additional builder. If desired, builders other than sodium triphosphate, such as sodium orthophosphate, sodium nitrilotriacetate, or other organic builders may also be used.

The products may also contain lather controlling agents, if desired, for giving extra control of lather at elevated temperatures. As such can be mentioned long chain fatty acid soap, e.g. sodium stearate, and silicones. Furthermore, a stabiliser may be necessary for certain percompounds.

Accordingly, the contents of the bleach products of the invention may comprise the following components, expressed in percents by weight:

| | broad range | preferred range |
|---|---|---|
| percompound | 5–100% | 10–50% |
| alkaline material | 0–70% | 0–60% |
| builder | 0–50% | 10–30% |
| anti-foaming agent | 0–20% | 0.2–10% |
| activator | 0–50% | 0–35% |
| stabiliser | 0–70% | 0–50% |

EXAMPLES I–II

Two rectangular-shaped polyester fibre bags of a size 100×80 cm were filled with 4.5 grams, resp. 39.2 grams of the following bleach compositions:

| | I | II |
|---|---|---|
| sodium perborate tetrahydrate | 12.6 g | 6.3 g |
| sodium metasilicate | 23.0 g | 23.0 g |
| sodium triphosphate | 7.6 g | 7.6 g |
| sodium stearate | 2.3 g | 2.3 g. |

The bags were heat-sealed and then coated with stearic acid. Each bleach product was introduced together with 4 kg of wash load in the drum of a Brandt 432 washing machine and the machine was set for washing at 85° C. washcycle, using a non-bleaching detergent composition of the following composition:

| | |
|---|---|
| alkylbenzene sulphonate | 7.0% |
| sodiumstearate | 2.0% |
| $C_{11}$–$C_{13}$ alcohol condensed with 11 ethyleneoxide | 3.5% |
| sodium triphosphate | 25.0% |
| sodiumsilicate | 12.0% |
| Alcalase (2200 GU/mg) | 0.22% |
| sodium carboxymethyl cellulose | 0.5% |
| fluorescer | 0.13% |
| sodium sulphate, perfume, water up to | 100% |

The results from reflectance measurements, compared with those compared with those obtained from a similar washing using a conventional commercial bleach detergent composition containing 24% of sodium perborate at the conventional dosage of 175 grams, are shown in the following Table A.

TABLE A

| Ingredient | | | Conventional powder | Powder | Product I | Powder | Product II |
|---|---|---|---|---|---|---|---|
| sodium perborate | | | 42 | — | 12.6 g | — | 6.3 g |
| sodium metasilicate | | | — | — | 23.0 g | — | 23.0 g |
| sodium triphosphate | | | 83.7 g | 64.7 g | 7.6 g | 64.7 g | 7.6 g |
| soap | | | 7.2 g | 3.5 g | 2.3 g | 3.5 g | 2.3 g |
| remainder (identical for the three formulations) | | | | | | | |
| Detergency | | | | | | | |
| on artificial soil | | | 66.4 | 69 | | 68 | |
| on artificial soil + protein | | | 70.2 | 73.6 | | 72.6 | |
| bleaching performance | | | | | | | |
| on tea-stain | | | 38.9 | 52.6 | | 45.4 | |
| pH | prewash | | 7.9 | 7–7.5 | | 7–7.5 | |
| | main wash | 40° C. | 9.4 | 10 | | 10 | |
| | | 60° C. | | 10.4 | | 10.4 | |
| | rinse | | 7.7 | 7.4–7.8 | | 7.4–7.8 | |

From the pH measurements it can be seen that the protective coating disintegrates within the temperature range of 40°–60° C. These results show that, by using the bleach products of the invention, a substantial saving of perborate can be achieved.

EXAMPLE III

A rectangular-shaped polyester fibre bag of 100×80 mm in size was filled with 52.5 grams of the following bleach composition:

| | |
|---|---|
| sodium perborate | 9.5 g |
| sodium metasilicate | 34.4 g |

-continued

| | |
|---|---|
| sodium triphosphate | 8.6 g |
| sodium stearate | 3.4 g |

The bag was heat-sealed and then coated with stearic acid. The bleach product was tested and compared with a conventional detergent bleach powder (containing 22% of sodium perborate) under the conditions of Examples I–II.

The average results of 16 washings are shown in Table B.

TABLE B

| Ingredients | Conventional powder | Powder | Product III |
|---|---|---|---|
| sodium perborate | 37.8 g | — | 9.5 g |
| sodium metasilicate | — | — | 34.4 g |
| sodium triphosphate | 58.3 g | 39.3 g | 8.6 g |
| sodium stearate | — | — | 3.4 g |
| remainder (identical for the two formulations on natural soiled articles) | | | |
| Washing efficiency | 71.8 | | 72 |
| Detergency | | | |
| artificial soil test cloth (reflectance) | 66.8 | | 66.4 |
| fat-soiled test cloth (reflectance) | 76.4 | | 76.5 |
| enzymatic efficiency (reflectance) | | | |
| protein soil test cloth | 67.6 | | 68.00 |
| Bleaching efficiency on | ΔR | | ΔR |
| tea stain | 5.8 | | 17.5 |

Again these results show an improved bleaching with less sodium perborate.

EXAMPLE IV

A rectangular-shaped polyester fibre bag of 60×60 mm in size was filled with 21.2 grams of the following bleach composition:

| | |
|---|---|
| sodium perborate | 12 g |
| tetra acetyl ethylene diamine | 9.2 g (activator) |

The bag was heat-sealed and then coated with a mixture of stearic acid and tallow fatty acid.

The bleach product was introduced with 4 kg of washload in the presence of catalase into the drum of a Brandt 432 washing machine and the machine was set for washing at 60° and 85°, using a nonbleaching detergent product of the following composition:

| | |
|---|---|
| alkylbenzene sulfonate | 7% |
| sodium stearate | 4% |
| ethoxylated fatty alcohol | 3.5% |
| sodium triphosphate | 35% |
| sodium silicate | 6% |
| sodium carboxymethyl cellulose | 0.7% |
| fluorescer | 0.2% |
| sodium sulfate, perfume, stabiliser, water up to | 100%. |

The results, compared with those obtained from a similar washing using a bleach detergent composition containing 6% of sodium perborate and 4.6% of tetraacetyl ethylene diamine at the conventional dosage of 200 g, are shown in the following Table.

TABLE C

| Bleach ingredients | In powder | Product IV (bag) |
|---|---|---|
| sodium perborate | 12 g | 12 g |
| tetraacetyl ethylene diamine | 9.6 g | 9.6 g |
| Bleaching efficiency | ΔR | ΔR |
| on tea stain | | |
| at 60° | 1.4 | 5.4 |
| at 85° | 16.0 | 20.2 |

These results show that, by using the bleach products of the invention, a substantial improvement of bleaching efficiency can be achieved.

EXAMPLE V

A rectangular-shaped polyester fibre bag of 60×60 mm in size, was filled with 10 grams of diperisophthalic acid including a stabiliser. The bag was sewn and coated with $C_{16}$–$C_{20}$ fatty alcohol/25 EO (mp 42°–45° C.). The bleach product was introduced with 4 kg of washload, in the presence of catalase, into the drum of a Brandt 432 washing machine and the machine was set for washing at 60° using a non-bleaching detergent product of the following composition:

| | |
|---|---|
| alkylbenzene sulfonate | 7% |
| sodium stearate | 4% |
| ethoxylated fatty alcohol | 3.5% |
| sodium triphosphate | 35% |
| sodium silicate | 6% |
| sodium carboxymethyl cellulose | 0.7% |
| fluorescer | 0.2% |
| enzymatic noodles | 1.6% |
| sodium sulfate, perfume water up to | 100% |

The results, compared with those obtained from a similar washing using a bleach detergent composition containing 5% of the disperisophthalic acid mix at the conventional dosage of 200 g, are shown in the following Table.

TABLE D

| Bleach ingredient | In powder | Product V (bag) |
|---|---|---|
| diperisophthalic acid mix | 10 g | 10 g |
| Bleaching efficiency | ΔR | ΔR |
| on tea stain | 6.9 | 9.8 |
| enzymatic efficiency | 7.2 | 20.6 |

These results show that, with this invention, mechanical loss is reduced; moreover, the detrimental effect of diperisophthalic acid upon enzymes is delayed, and therefore improvement in enzymatic efficiency is obtained.

EXAMPLE VI

This Example shows application of polyvinylalcohol to the sheet material before forming the bags.

The polyester fabric was coated with a polyvinyl alcohol mix of the following composition:

| | Possible % | Desired % |
|---|---|---|
| polyvinyl alcohol a/b* | 10 to 20% | 10–15% |
| glycerin | 0 to 10% | 0–2.5% |
| water | 80 to 90% | 85% |

Polyvinyl alcohol is more or less soluble in water, depending on its level of hydrolysis: its solubility decreases with increasing -continued

| | Possible % | Desired % |
|---|---|---|
| level of hydrolysis. | | |

*a, which represents the degree of condensation, is the viscosity, expressed in centipoises, of the 4% in weight aqueous solution, as measured at 20° C. with the Oswalt viscometer; it can vary from 4 t0 60.
b, which is the ester index or level of hydrolysis, can vary from 5 to 300, corresponding to levels of hydrolysis, in % of molecules, ranging from 99.5 to 70%.

The double coating is made in the following way:

The fabric is rapidly soaked in the polyvinyl alcohol mix, then dried at 110° C. for 5 to 10 minutes; it is soaked again and dried at 110° C. for 10 to 20 minutes.

The amount of PVA coating mix per bag is equal to 1 to 3 grams, depending on its viscosity.

Rectangular-shaped bags of 90×70 cm in size were made from the above coated polyester sheet materials, filled with 40 g of sodium metasilicate + 10 g percarbonate and heat-sealed.

A bag was introduced with 4 kg of washload into the drum of a Brandt 432 washing machine, and the machine was set for washing at 85° C.

The pH was measured as a function of the batch temperature in order to folow the dissolution of the coating. The results for one bag coated with PVA 30/5 (ex Rhone-Poulenc) were as follows:

| Temperature | pH |
|---|---|
| 25 | 8.70 |
| 40 | 8.85 |
| 50 | 8.90 |
| 60 | 9.10 |
| 65 | 9.15 |
| 75 | 9.40 |
| 80 | 10.40 |

The above particular coating dissolves completely at about 75° C.

The temperature of dissolution of the coating can be adjusted by varying the composition of the PVA-mix and the values a and b of the PVA.

I claim:

1. A bleach product comprising a percompound contained within a closed water-insoluble but water-permeable bag of fibrous sheet material in the form of paper or of woven or non woven fabric provided with a protective water-impermeable coating, removable in water at a temperature of 30°–75° C. said coating being of an organic material which is solid at room temperature.

2. A bleach product according to claim 1, wherein the protective coating is removable at a temperature of 35°–65° C.

3. A bleach product according to claim 1 or 2, wherein the material for said protective coating is selected from the group consisting of waxes, fatty acids, algic acids, ethoxylated or non-ethoxylated fatty alcohols and polyvinyl alcohols.

4. A bleach product according to claim 1, comprising an inorganic percompound and an alkaline material to provide an initial pH in solution of about 10–12.

5. A bleach product according to claim 4, wherein said alkali material is selected from the group consisting of alkalimetal silicates, alkalimetal hydroxides and mixtures thereof.

6. A bleach product according to claim 1, comprising an inorganic percompound and an activator for said percompound.

7. A bleach product according to claim 1, comprising an organic peracid.

8. A bleach product according to claim 4 or 5, wherein the protective coating is removable at a temperature of 50°–75° C.

9. A bleach product according to claim 6 or 7, wherein the protective coating is removable at a temperature of 30°–50° C.

10. A bleach product according to claim 6, wherein said activator is present in a weight ratio to the percompound of 1:1 to 1:35.

11. A bleach product according to claim 1, comprising 0.4 to 20 grams of a percompound.

12. A bleach product according to claim 11, comprising 1 to 15 grams of said percompound.

* * * * *